US007561815B2

(12) United States Patent
Kamijo et al.

(10) Patent No.: US 7,561,815 B2
(45) Date of Patent: Jul. 14, 2009

(54) IMAGE FORMING APPARATUS THAT CONTROLS DEVELOPMENT CONDITIONS BASED ON PAPER TYPE

(75) Inventors: Koichi Kamijo, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 457 days.

(21) Appl. No.: 11/466,711

(22) Filed: Aug. 23, 2006

(65) Prior Publication Data

US 2007/0047985 A1 Mar. 1, 2007

(30) Foreign Application Priority Data

Aug. 24, 2005 (JP) ..... 2005-242366
Aug. 24, 2005 (JP) ..... 2005-242368
Aug. 24, 2005 (JP) ..... 2005-242370

(51) Int. Cl.
*G03G 15/10* (2006.01)

(52) U.S. Cl. ..... 399/45; 399/57

(58) Field of Classification Search ..... 399/45, 399/57, 237, 238

See application file for complete search history.

(56) References Cited

U.S. PATENT DOCUMENTS 5,689,761 A * 11/1997 Denton et al. ..... 399/45
7,460,802 B2 * 12/2008 Nakamura et al. ..... 399/45

FOREIGN PATENT DOCUMENTS

JP 10-282796 10/1998
JP 2003-091161 3/2003

* cited by examiner

*Primary Examiner*—William J Royer
(74) *Attorney, Agent, or Firm*—Hogan & Hartson LLP

(57) ABSTRACT

A development system includes a development roller that carries developer, a developer supplying roller that supplies developer to the development roller, a developer container that supplies developer to the developer supplying roller, and a photoconductor on which a developed image is formed with the developer carried by the development roller. The developed image is transferred on the photoconductor. A toner tank reserves developer having a higher concentration than that of the developer in the developer container. A liquid carrier tank reserves liquid carrier. High-concentration developer is fed from the toner tank and liquid carrier is fed from the liquid carrier tank into a developer concentration adjusting tank. A developer concentration adjustment controlling section controls development conditions depending on an input paper type.

17 Claims, 9 Drawing Sheets

Fig.8

| | Paper type | Roughness of paper Rz [μm] | Circumferential velocity of the development roller [mm/s] | Circumferential velocity of the developer supplying roller [mm/s] | Circumferential velocity differential (Circumferential velocity of the development roller – Circumferential velocity of the developer supplying roller) [mm/s] | Film thickness [μm] (about 50% is transferred to the development roller relative to 13μm groove film thickness) |
|---|---|---|---|---|---|---|
| | Default paper (J paper) | 30 | 214 | 214 | 0 | 6.5 |
| Sub 1 | Rough paper (e.g. Neenah bond paper) | 50 | 235 | 214 | 21 | 7.15 |
| Sub 2 | Coated paper (e.g. Zanders ikono silk) | 7 | 203 | 214 | -11 | 6.2 |

Fig.10
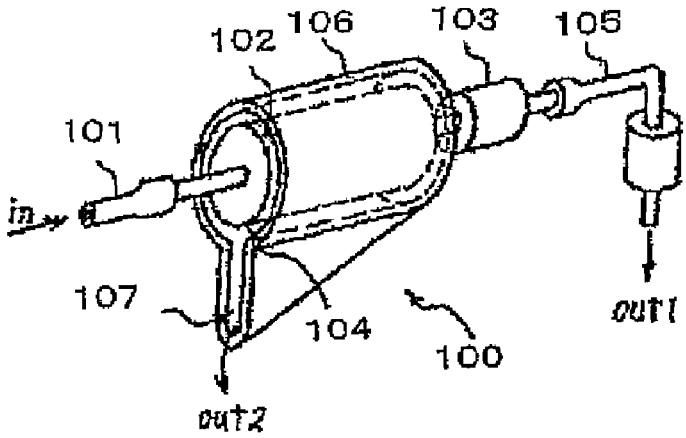
PRIOR ART
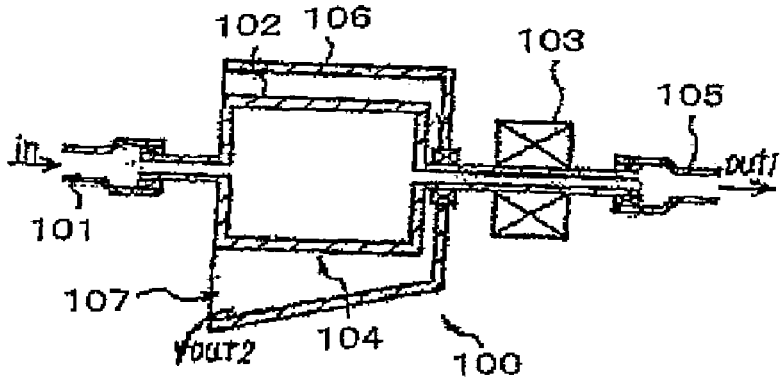
PRIOR ART

IMAGE FORMING APPARATUS THAT CONTROLS DEVELOPMENT CONDITIONS BASED ON PAPER TYPE

CROSS-REFERENCE TO RELATED APPLICATIONS

This application is based upon and claims the benefit of priority from prior Japanese Patent Applications No. 2005-242366, No. 2005-242368, and No. 2005-242370, filed Aug. 24, 2005, the entire contents of which are incorporated herein by reference.

BACKGROUND

1. Technical Field

The present invention relates to a development system for developing an electrostatic latent image formed on a photoconductor with developer in which toner particles are dispersed into carrier liquid and relates to an image forming apparatus using the same.

2. Related Art

In an electrophotographic development system using a liquid developer, there has been conventionally known a technology for adjusting the amount of the carrier liquid. Specifically, the liquid removing force of a sweep roller is varied based on the property of a transfer paper by an eccentric cam or the like so as to remove excess liquid developer by a suitable amount, thereby regulating a liquid film. Since the sweep roller abuts on a photoconductor drum, high-viscosity and high-concentration liquid developer which is hardly removed is easily removed and the mechanical accuracy of the sweep roller and the photoconductor drum is easily maintained (see JP-A-2003-91161).

Also in an electrophotographic development system using a liquid developer, there has been conventionally known a technology of adjusting the concentration of a liquid developer. FIG. 10 is a conventional concentration adjusting apparatus. Numeral 100 designates the concentration adjusting apparatus, 101 designates a developer inlet, 102 designates a developer concentration adjusting tank, 103 designates a motor, 104 designates a sleeve, 105 designates a first developer drain passage, 106 designates a collection tank, and 107 designates a second developer drain passage.

In the concentration adjusting apparatus 100, a liquid developer is injected into the developer concentration adjusting tank 102 through the developer inlet 101. The motor 103 is driven to exert centrifugal force on the liquid developer to form a distribution of concentration of toner having low concentration in the vicinity of the rotation center and high concentration in the vicinity of the sleeve 104 in the developer concentration adjusting tank 102. The low-concentration liquid developer in the vicinity of the rotation center is drawn through the first developer drain passage 105. On the other hand, the high-concentration liquid developer is scattered through an opening of the sleeve 104 and drawn through the second developer drain passage 107 at the bottom of the collection tank 106. That is, desired high-concentration liquid developer and desired low-concentration liquid developer can be drawn. Using the drawn developers allows the concentration control (see JP-A-10-282796).

However, JP-A-2003-91161 has a problem when a transfer paper or the like having rough surface is set. Because a larger amount of developer is required to adhere when such a paper is set, the sweep roller is spaced apart from the photoconductor drum. In this state, the sweep roller does not remove excess liquid carrier from the developer layer formed on the photoconductor drum. When a transfer paper having rough surface is set and the developer contains a large amount of liquid carrier, toner particles are drawn by fibers of the transfer paper together with the liquid carrier so as not to obtain a desired concentration. In addition, JP-A-10-282796 has a problem when a developer supplying roller with grooves such as an anilox roller is employed. Because the grooves are clogged with toner particles when the concentration of the developer is increased, it is impossible to measure the thickness of the film with accuracy.

SUMMARY

It is an object of the invention to solve the aforementioned problems and to provide a development system capable of keeping the density constant relative to a variety of paper types. It is another object of the invention to provide a development system capable of preventing grooves from being clogged with the developer even when a developer supplying roller with the grooves such as an anilox roller is employed.

According to a first aspect of the invention, there is provided a development system comprising: an image forming section including a development roller for carrying developer, a developer supplying roller for supplying the developer to the development roller, a developer container for supplying the developer to the developer supplying roller, a photoconductor on which a developed image is formed with the developer carried by the development roller, and a transfer means for transferring the developed image on the photoconductor; a developer concentration adjusting section including a toner tank for reserving developer of which concentration is higher than that of the developer in the developer container, a liquid carrier tank for reserving liquid carrier, and a developer concentration adjusting tank into which the high-concentration developer is fed from the toner tank and the liquid carrier is fed from the liquid carrier tank; a paper type input means for inputting a paper type; and a developer concentration adjustment controlling section for controlling development conditions depending on the paper type inputted by the paper type input means.

It is preferable that the developer concentration adjustment controlling section controls the developer concentration adjusting section to adjust the concentration of the developer depending on the paper type inputted by the paper type input means.

Further, it is preferable that when the paper type input means inputs that the subject paper is a paper having a surface roughness larger than that of a regular paper, the developer in the developer concentration adjusting tank is controlled to have higher concentration.

Further, it is preferable that when the paper type input means inputs that the subject paper is a paper having a surface roughness larger than that of a regular paper, the developer concentration adjustment controlling section increases the contrast potential of the photoconductor and the development roller.

Further, it is preferable that the developer concentration adjusting section comprises a motor and an agitating member which is driven by the motor to agitate the developer in the developer concentration adjusting tank, and the developer concentration adjustment controlling section comprises a torque sensor for detecting a torque value of the motor and a developer concentration database for storing data of developer concentrations corresponding to torque values of the motor and calculates the developer concentration from the value detected by the torque sensor and the data in the developer concentration data base.

Further, it is preferable that the developer concentration adjustment controlling section controls the circumferential velocity differential between the developer supplying roller and the development roller depending on the paper type inputted by the paper type input means.

Further, it is preferable that when the paper type input means inputs that the subject paper is a paper having a surface roughness larger than that of a regular paper, the circumferential velocity of the developer supplying roller is controlled to be higher than the circumferential velocity of the development roller.

Further, it is preferable that when the paper type input means inputs that the subject paper is a paper having a surface roughness larger than that of a regular paper, the developer concentration adjustment controlling section increases the contrast potential of the photoconductor and the development roller.

Further, it is preferable that when the paper type input means inputs that the subject paper is a paper having a surface roughness smaller than that of a regular paper, the circumferential velocity of the developer supplying roller is controlled to be lower than the circumferential velocity of the development roller Further, it is preferable that the developer concentration adjusting section comprises a motor and an agitating member which is driven by the motor to agitate the developer in the developer concentration adjusting tank, and the developer concentration adjustment controlling section comprises a torque sensor for detecting a torque value of the motor and a developer concentration database for storing data of developer concentrations corresponding to torque values of the motor and calculates the developer concentration from the value detected by the torque sensor and the data in the developer concentration data base.

Further, it is preferable that the photoconductor has a photoconductor liquid carrier removing means for removing the liquid carrier on the photoconductor.

According to a second aspect of the invention, there is provided a development system comprising: an image forming section including a development roller for carrying developer, a developer supplying roller having grooves formed therein for supplying the developer to the development roller, a developer container for supplying the developer to the developer supplying roller, a photoconductor on which a developed image is formed with the developer carried by the development roller, and a transfer means for transferring the developed image on the photoconductor; and a developer concentration adjusting section including a toner tank for reserving developer of which concentration is higher than that of the developer in the developer container, a liquid carrier tank for reserving liquid carrier, and a developer concentration adjusting tank into which the high-concentration developer is fed from the toner tank and the liquid carrier is fed from the liquid carrier tank, wherein the developed image is formed by the image forming section with the developer of which concentration is adjusted by the developer concentration adjusting section, said development system further comprising a developer concentration adjustment controlling section including a control means for controlling the developer concentration adjusting section to adjust the developer concentration depending on the image forming condition, wherein the developer concentration adjustment controlling section carries out a termination sequence of terminating the action of the apparatus after controlling the developer concentration in the developer concentration adjusting tank to be lower than a default value at the termination of printing operation.

It is preferable that the developer concentration adjustment controller includes a paper type input means for inputting a paper type and controls the control means depending on the paper type inputted by the paper type input means.

Further, it is preferable that the developer concentration adjusting section comprises a motor and an agitating member which is driven by the motor to agitate the developer in the developer concentration adjusting tank, and the developer concentration adjustment controlling section comprises a torque sensor for detecting a torque value of the motor and a developer concentration database for storing data of developer concentrations corresponding to torque values of the motor, wherein the control means calculates the developer concentration from the value detected by the torque sensor and the data in the developer concentration database.

According to a third aspect of the invention, there is provided an image forming apparatus comprising: an image forming section including a development roller for carrying developer, a developer supplying roller for supplying the developer to the development roller, a developer container for supplying the developer to the developer supplying roller, a photoconductor on which a developed image is formed with the developer carried by the development roller, an intermediate transfer belt to which the developed image on the photoconductor is transferred, a primary transfer roller which is disposed inside the intermediate transfer belt to face the development roller, an intermediate transfer belt squeezing roller for recovering liquid carrier on the intermediate transfer belt, a squeezing roller cleaner for scraping the liquid carrier recovered on the intermediate transfer belt squeezing roller, a squeezing roller cleaner reservoir for reserving the liquid carrier scraped by the squeezing roller cleaner, and a secondary transfer roller for transferring the transferred image on the intermediate transfer belt to a paper sheet; and a developer concentration adjusting section including a toner tank for reserving developer of which concentration is higher than the concentration of the developer in the developer container, a liquid carrier tank for reserving liquid carrier, a developer concentration adjusting tank into which the high-concentration developer is fed from the toner tank and the liquid carrier is fed from the liquid carrier tank so as to adjust the concentration of the developer, and a paper type input means for inputting a paper type, wherein the image forming apparatus further comprises a developer concentration adjustment controlling section for controlling development conditions depending on the paper type inputted by the paper type input means.

It is preferable that the developer concentration adjustment controlling section controls the developer concentration adjusting section to adjust the concentration of the developer depending on the paper type inputted by the paper type input means.

Further, it is preferable that the developer concentration adjustment controlling section controls the circumferential velocity differential between the developer supplying roller and the development roller depending on the paper type inputted by the paper type input means.

Still other objects and advantages of the invention will in part be obvious and will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

The invention will be described with reference to the accompanying drawings, wherein like numbers reference like elements.

FIG. 8 is a graph showing a first embodiment of the invention;

FIG. 10 is illustrations showing a conventional concentration adjusting apparatus.

DESCRIPTION OF EXEMPLARY EMBODIMENTS

Figure 1:
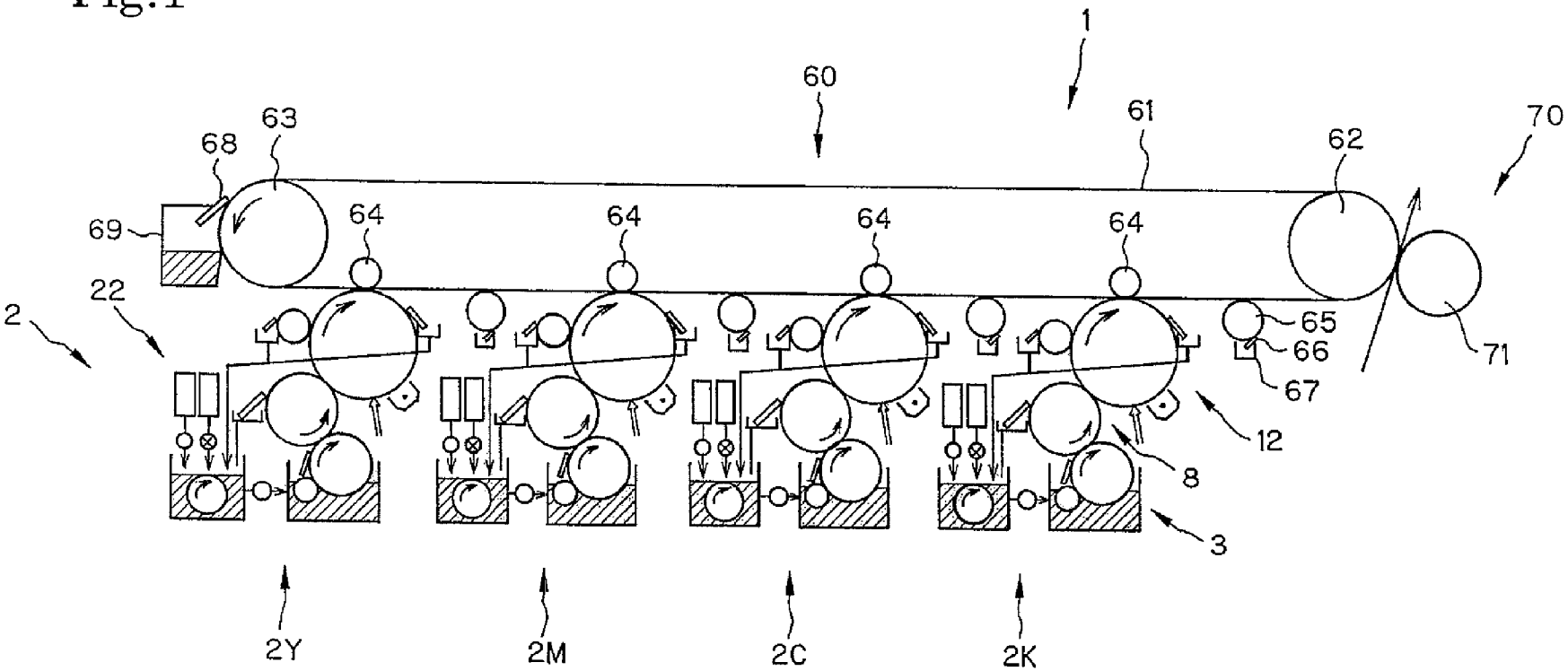
FIG. 1 is an illustration showing an image forming section according to the invention.

Hereinafter, an embodiment of the invention will be described with reference to the attached drawings. FIG. 1 is an illustration showing an entire arrangement of an image forming section according to the invention. Numeral 1 designates the image forming section, 2 designates a developing device, 2Y designates a yellow developing unit, 2M designates a magenta developing unit, 2C designates a cyan developing unit, 2K designates a black developing unit, 60 designates an intermediate transfer unit, 61 designates an intermediate transfer belt, 62 designates a driving roller, 63 designates a driven roller, 64 designates a primary transfer roller, 65 designates an intermediate transfer belt squeezing roller, 66 designates a squeezing roller cleaner, 67 designates a squeezing roller cleaner reservoir for liquid recovered by the squeezing roller cleaner, 66, 68 designates an intermediate transfer belt cleaner, 69 designates an intermediate transfer belt cleaner reservoir for liquid recovered by the intermediate transfer belt cleaner, 68, 70 designates a secondary transfer unit, and 71 designates a secondary transfer roller.

The developing device 2 comprises, as four developing units, the yellow developing unit 2Y the magenta developing unit 2M, the cyan developing unit 2C, and the black developing unit 2K. In the developing units 2Y, 2M, 2C, and 2K, latent images for yellow Y, magenta M, cyan C, and black K are developed with liquid developers as developers of colors, i.e. yellow Y, magenta M, cyan C, and black K, respectively. The structure of the developing device 2 will be described in detail later.

The intermediate transfer unit 60 comprises the intermediate transfer belt 61 which is an endless belt, the driving roller 62 and the driven roller 63 on which the intermediate transfer belt 61 is laid to extend therebetween with some tension, the primary transfer rollers 64 which are disposed inside the intermediate transfer belt 61 to face the developing device 2, the intermediate transfer belt squeezing roller 65 for recovering liquid carrier on the intermediate transfer belt 61, the squeezing roller cleaner 66 for scraping away the liquid carrier recovered onto the intermediate transfer belt squeezing roller 65, the squeezing roller cleaner reservoir 67 for reserving the liquid carrier scraped by the squeezing roller cleaner 66, the intermediate transfer belt cleaner 68 which is disposed such that the driven roller 63 functions as a backup roller thereof, and the intermediate transfer belt cleaner reservoir 69 for reserving the developer scraped by the intermediate transfer belt cleaner 68.

The intermediate transfer unit 60 transfers toner images of respective colors developed by the developing device 2 to a surface of the intermediate transfer belt 61. The intermediate transfer belt 61 is driven to rotate by the driving roller 62.

Along a linear portion of the intermediate transfer belt 61 of the intermediate transfer unit 60, the developing units 2Y, 2M, 2C, and 2K for respective colors are arranged in the order of colors Y, M, C, K from the upstream side in the rotational direction of the intermediate transfer belt 61. It should be understood that the arrangement order of the developing units 2Y, 2M, 2C, 2K may not be the order of the illustrated example and may be any order.

In the image forming section 1 having the aforementioned structure, first, a latent image is developed by the developing unit 2Y for yellow Y to form a toner image of yellow Y and the toner image is transferred to the surface of the intermediate transfer belt 61. Then, a latent image is developed by the developing unit 2M for magenta M to form a toner image of magenta M and the toner image is transferred to the surface of the intermediate transfer belt 61 such that the toner image of magenta M is superposed on the toner image of yellow Y. Similarly, a latent image is developed by the developing unit 2C for cyan C to form a toner image of cyan C and the toner image is transferred to the surface of the intermediate transfer belt 61 such that the toner image of cyan C is superposed on the toner images of yellow Y and magenta M. Further, a latent image is developed by the developing unit 2K for black K to form a toner image of black K and the toner image is transferred to the surface of the intermediate transfer belt 61 such that the toner image of black K is superposed on the toner images of yellow Y, magenta M, and cyan C.

The liquid carrier on the intermediate transfer belt 61 is recovered by the intermediate transfer belt squeezing roller 65 which is disposed on the downstream side in the rotational direction of the intermediate transfer belt 61 relative to the developing units 2Y, 2M, 2C, and 2K and is rotated at a speed equal to that of the intermediate transfer belt 61. The liquid carrier recovered onto the intermediate transfer belt squeezing roller 65 is scraped by the squeezing roller cleaner 66 and is reserved in the squeezing roller cleaner reservoir 67.

After that, the color toner image, which is formed by superposing the toner images of the respective colors transferred to the intermediate transfer belt 61, is transferred to a paper sheet by the secondary transfer roller 71 of the secondary transfer unit 70. Developer remaining on the intermediate transfer belt 61 is scraped by the intermediate transfer belt cleaner 68 which is disposed such that the driven roller 63 functions as the backup roller thereof and is reserved in the intermediate transfer belt cleaner reservoir 69. The intermediate transfer unit 60 and the secondary transfer unit 70 compose a transfer means.

Hereinafter, the developing device 2 will be described. In the image forming section 1, the developing device 2 comprises the yellow developing unit 2Y, the magenta developing unit 2M, the cyan developing unit 2C, and the black developing unit 2K. Since the respective developing units have the same structure, description will be made with regard to the black developing unit 2K as a representative.

Figure 2:
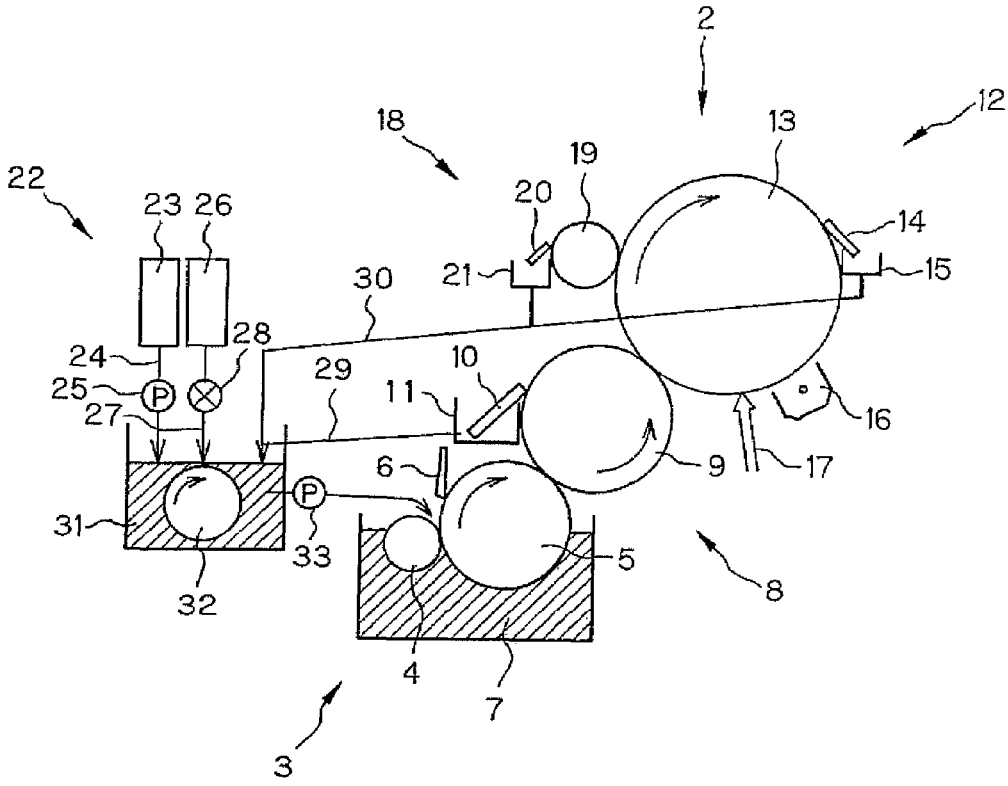
FIG. 2 is an illustration showing a developing unit according to the invention.

FIG. 2 is an illustration showing the black developing unit 2K. Numeral 2K designates the black developing unit, 3 designates a developer supplying section, 4 designates a leveling roller, 5 designates a developer supplying roller, 6 designates a developer regulating blade, 7 designates a developer container, 8 designates a developing section, 9 designates a development roller, 10 designates a development roller cleaner, 11 designates a development roller cleaner reservoir, 12 designates a photoconductive section, 13 designates a photoconductor, 14 designates a photoconductor cleaner, 15 designates a photoconductor cleaner reservoir. 16 designates a charging section, 17 designates an exposure section, 18 designates a squeezing section, 19 designates a squeezing roller, 20 designates a squeezing roller cleaner, and 21 designates a squeezing roller cleaner reservoir.

The developer supplying section 3 comprises the leveling roller 4, the developer supplying roller 5, the developer regulating blade 6, and the developer container 7. The leveling roller 4 is a roller having a function of scooping the developer to the developer supplying roller 5 and a function of agitating the developer in the developer container 7 to maintain the developer in the suitable state. The developer supplying roller 5 is a cylindrical member witch rotates in the clockwise direction as seen from the front of FIG. 2 and has helical grooves finely and uniformly formed in the surface thereof, i.e. an anilox roller. As for the size of the grooves, the groove pitch is about 130 μm and the groove depth is about 30 μm.

Figure 3:
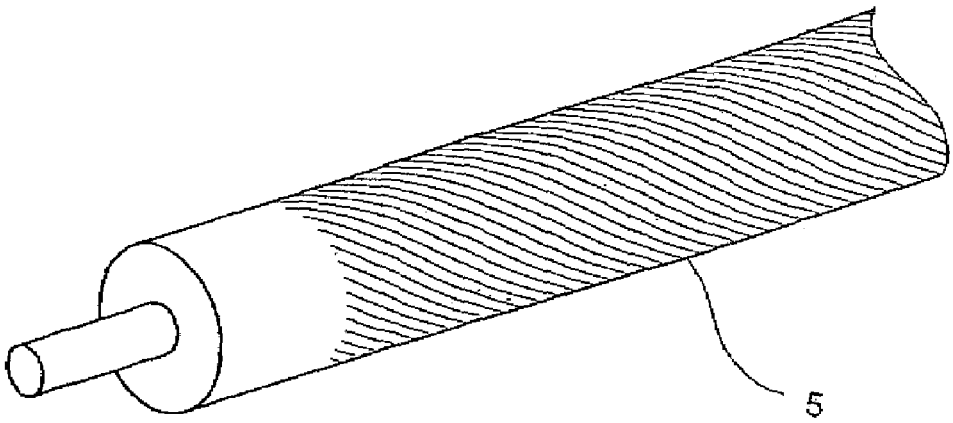
FIG. 3 is a perspective view of a developer supplying roller according to the invention.
Figure 4:
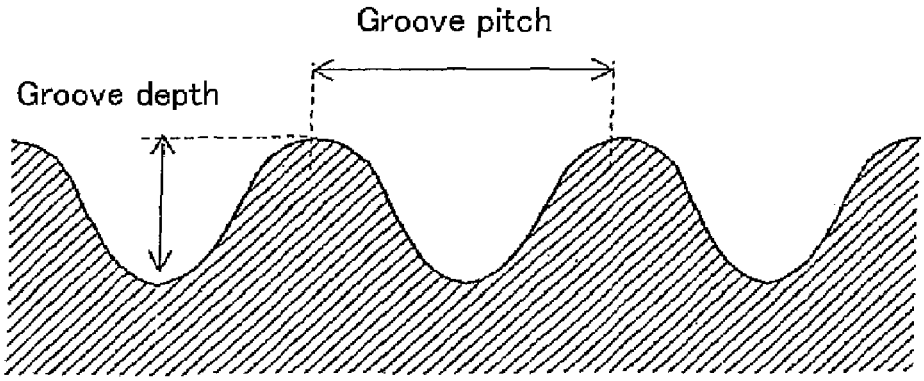
FIG. 4 is an illustration showing the pitch and depth of grooves of the developer supplying roller according to the invention.
Figure 5:
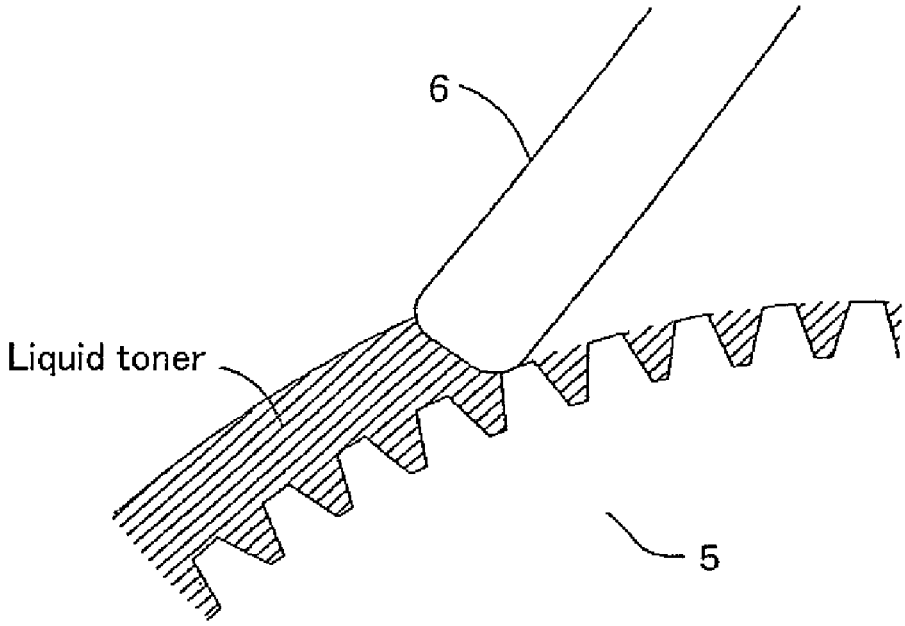
FIG. 5 is an illustration of a state that the amount of toner is regulated by a developer regulating blade according to the invention.

FIG. 3 is a perspective view of the developer supplying roller 5, FIG. 4 is an illustration showing the pitch and depth of grooves of the developer supplying roller 5. FIG. 5 is an illustration of a state that the amount of toner is regulated by a developer regulating blade 6.

The developer regulating blade 6 comprises a rubber portion made of urethane rubber which abuts the developer supplying roller 5 and a metal plate portion for supporting the rubber portion. The developer regulating blade 6 is adapted to scrape and remove liquid toner remaining on the developer supplying roller 5.

The developer container 7 is a container such as a tank for reserving developer scraped by the developer regulating blade 6 and developer carried from a concentration adjusting tank 31 as will be described later. In the developer container 7 of the developer supplying section 3, liquid toner as the developer is reserved. The liquid toner is prepared in the following manner. That is, colorant such as pigment is dispersed into thermoplastic resin so as to make solid particles of which mean particle size is 1 μm. The solid particles are added to liquid solvent such as organic solvent, silicone oil, mineral oil, or edible oil together with dispersing agent so as to prepare the liquid toner of which the concentration of toner solid matter is about 20%.

The developing section 8 comprises the development roller 9, development roller cleaner 10, and the development roller cleaner reservoir 11. The development roller 9 is a cylindrical member of which width is about 320 mm and which rotates in the counter-clockwise direction, as seen from the front of FIG. 2, about its axis. The development roller 9 comprises a metal core made of metal such as iron, an elastic member such as conductive urethane rubber which is formed on the peripheral surface of the metal core, and a resin layer or a rubber layer which is formed outermost. The development roller cleaner 10 comprises a rubber which abuts the surface of the development roller 9 and is adapted to scrape the developer remaining on the development roller 9. The development roller cleaner reservoir 11 is a container such as a tank for reserving the developer scraped by the development roller cleaner 10.

The photoconductive section 12 comprises the photoconductor 13, the photoconductor cleaner 14, and the photoconductor cleaner reservoir 15. The photoconductor 13 is a cylindrical member with a photoconductive layer formed on the peripheral surface thereof and is adapted to rotate about its axis. In this embodiment, the photoconductor 13 rotates in the clockwise direction as shown by an arrow. The photoconductor 13 is composed of an organic photoconductive member or an amorphous silicon photoconductive material. The photoconductor cleaner 14 is made of rubber and is adapted to abut the surface of the photoconductor 13 to scrape and remove the developer remaining on the photoconductor 13. The photoconductor cleaner reservoir 15 is a container such as a tank for reserving the developer scraped by the photoconductor cleaner 14.

The charging section 16 and the exposure section 17 are located upstream of the nip portion between the photoconductor 13 and the development roller 9. The charging section 16 is a section where a bias having the same polarity as the charging polarity of the liquid toner is applied from a power unit (not shown) to charge the photoconductor 13, while the exposure section 17 is a section where laser is emitted from a laser scanning optical system or the like to form a latent image on the charged photoconductor 13.

The squeezing section 18 comprises the squeezing roller 19, the squeezing roller cleaner 20, and the squeezing roller cleaner reservoir 21. The squeezing roller 19 is located downstream of the nip portion between the photoconductor 13 and the development roller 9 and is adapted to rotate about its axis in a direction opposite to the direction of the photoconductor 13. The squeezing roller 19 is preferably an elastic roller comprising a metal core made of metal, an elastic member made of conductive urethane rubber which is formed on the surface of the metal core, and an outer layer made of fluorocarbon resin which is formed outermost. The squeezing roller cleaner 20 is made of rubber and is adapted to abut the surface of the squeezing roller 19 to scrape and remove the developer remaining on the squeezing roller 19. The squeezing roller cleaner reservoir 21 is a container such as a tank for reserving the developer scraped by the squeezing roller cleaner 20.

Hereinafter, the normal printing operation of the development device 2 will be described. In the developer supplying section 3, the developer supplying roller 5 rotates about its axis at a surface velocity of 214 mm/sec in the circumferential direction so as to scoop up the liquid toner reserved in the developer container 7. The developer regulating blade 6 abuts the surface of the developer supplying roller 5 to scrape excess developer while leaving the developer in the grooves formed in the surface of the developer supplying roller 5, thereby regulating the amount of developer to be supplied to the development roller 9. In the embodiment, the film thickness of the developer applied to the development roller 9 is regulated to be about 6.5 μm. The developer scraped by the developer regulating blade 6 falls and returns to the developer container 7 by means of gravity. On the other hand, the developer not scraped by the developer regulating blade 6 is placed in the grooves formed in the surface of the developer supplying roller 5. In this state, the developer supplying roller 5 is in contact with the development roller 9 with some pressure, thereby applying the developer to the surface of the development roller 9. Applied to the developer supplying roller 5 is voltage of about +400V.

In the developing section 8, the development roller 9 has a width of about 320 mm and rotates at a surface velocity of about 214 mm/sec in the circumferential direction similarly to the developer supplying roller 5. The development roller 9 with the developer applied from the developer supplying roller 5 is in contact with the photoconductor 13.

In the photoconductive section 12, the charging section 16 applies voltage of about +5.5 kV to a wire of a corona charger at the location upstream of the nip portion between the photoconductor 13 and the development roller 9 so as to charge the surface of the photoconductor 13 to be about +800V. After that, the photoconductor 13 is irradiated by the exposure section 17 to form a latent image such that an imaging portion has an electric potential of +25V. At the nip portion where the development roller 9 is in contact with the photoconductor 13, toner particles are selectively moved to the imaging portion, i.e. the latent image formed on the photoconductor 13, according to the electric field that the bias applied to the development roller 9 is about +400V, the potential of the imaging portion is about +25V lower than the bias applied to the development roller 9, and the potential of the non-imaging portion is about +800V higher than the bias applied to the development roller 9, thereby forming a developed image of which width is the same of the width of the development roller 9. However, a slight amount of toner particles also adhere to the non-imaging portion, that is, fogging occurs. Since the liquid carrier is not influenced by the electric field, the liquid carrier is separated at the nip portion between the development roller 9 and the photoconductor 13 to adhere to both the development roller 9 and the photoconductor 13.

The development roller cleaner 10 abuts the surface of the development roller 9 at the location downstream of the nip portion between the photoconductor 13 and the development roller 9 to scrape the excess developer adhering to the surface of the development roller 9. The scraped developer falls and is collected into the development roller cleaner reservoir 11 by means of gravity.

After passing the nip portion relative to the development roller 9, the photoconductor 13 is in contact with the squeezing roller 19 with the imaging portion having a surface potential about +150V and the non-imaging portion having a surface potential about +550V. Applied to the squeezing roller 19 is a bias of about +300V which is intermediate between that of the imaging portion and that of the non-imaging portion. Accordingly, at the imaging portion, an electric field for pressing the toner particles to the photoconductor 13 is generated so that the toner particles are not recovered by the squeezing roller 19 and are thus still adhering to the photoconductor 13, and the liquid carrier which is not influenced by the electric field is separated at the end of the nip portion between the photoconductor 13 and the squeezing roller 19. On the other hand, at the non-imaging portion, an electric field for recovering the fog toner particles to the squeezing roller 19 is generated so that the fog toner particles are recovered by the squeezing roller 19, and the liquid carrier which is not influenced by the electric field is separated at the end of the nip portion between the photoconductor 13 and the squeezing roller 19.

The developer containing the fog toner particles recovered by and adhering to the squeezing roller 19 is scraped by the squeezing roller cleaner 20 which is in contact with the surface of the squeezing roller 19 at a location downstream of the nip portion relative to the photoconductor 13 and then falls and is collected into the squeezing roller cleaner reservoir 21 by means of gravity.

The photoconductor 13 passing the nip portion relative to the squeezing roller 19 has the pure image with the non-imaging portion having no or little toner particles and comes into a nip portion relative to the primary transfer roller 64 via the intermediate transfer belt 61. Applied to the primary transfer roller 64 is a voltage −200V of which polarity is opposite to the charging polarity of the toner particles. Accordingly, the developer on the photoconductor 13 is primarily transferred to the intermediate transfer belt 61 so that only the liquid carrier remains on the photoconductor 13. The liquid carrier remaining on the photoconductor 13 is scraped by the photoconductor cleaner 14 which is in contact with the surface of the photoconductor 13 at a location downstream of the nip portion relative to the primary transfer roller 64 via the intermediate transfer belt 61 and falls and is collected into the photoconductor cleaner reservoir 15 by means of gravity.

Hereinafter, an embodiment of a developer concentration adjusting section 22 will be described. In FIG. 2, numeral 22 designates the developer concentration adjusting section, 23 designates a toner tank, 24 designates a toner feeding passage, 25 designates a first pump, 26 designates a liquid carrier tank, 27 designates a liquid carrier feeding passage, 28 designates a first valve, 29 designates a first collected liquid carrier passage, 30 designates a second collected liquid carrier passage, 31 designates a developer concentration adjusting tank, 32 designates an agitating member, and 33 designates a second pump.

The toner tank 23 is a tank for reserving high-concentration toner of which solid concentration is about 40% and is connected to the developer concentration adjusting tank 31 through the toner feeding passage 24 and the first pump 25. The first pump 25 is a pump for supplying the high-concentration toner from the toner tank 23 to the developer concentration adjusting tank 31. The liquid carrier tank 26 is a tank for reserving the liquid carrier for the developer and is connected to the developer concentration adjusting tank 31 via the liquid carrier feeding passage 27 and the first valve 28. The first valve 28 is a valve which can open and close during supplying the liquid carrier.

The developer concentration adjusting tank 31 is a tank or the like for reserving the development collected in the developer roller cleaner reservoir 11, the developer collected in the photoconductor cleaner reservoir 15, the developer collected in the squeezing roller cleaner reservoir 21, the high-concentration toner supplied from the toner tank 23, and the liquid carrier supplied from the liquid carrier tank 26 and for adjusting the concentration.

The agitating member 32 is a member for continuously agitating the developer in the developer concentration adjusting tank 31. As the agitating member 32, a propeller is used in this embodiment. The second pump 33 is a pump for supplying the developer adjusted in the developer concentration adjusting tank 31 into the developer container 7.

The operation of the embodiment of the developer concentration adjusting section 22 will now be described with reference to FIG. 2 and FIG. 6. The developer scraped from the development roller 9 by the development roller cleaner 10 is carried from the development roller cleaner reservoir 11 to the developer concentration adjusting tank 31 through the first collected liquid carrier passage 29 by means of gravity. The developer collected in the photoconductor cleaner reservoir 15 and the squeezing roller cleaner reservoir 21 is carried to the developer concentration adjusting tank 31 through the second collected liquid carrier passage 30 by means of gravity. The recovered developer is continuously agitated by the agitating member 32 within the developer concentration adjusting tank 31.

Figure 6:
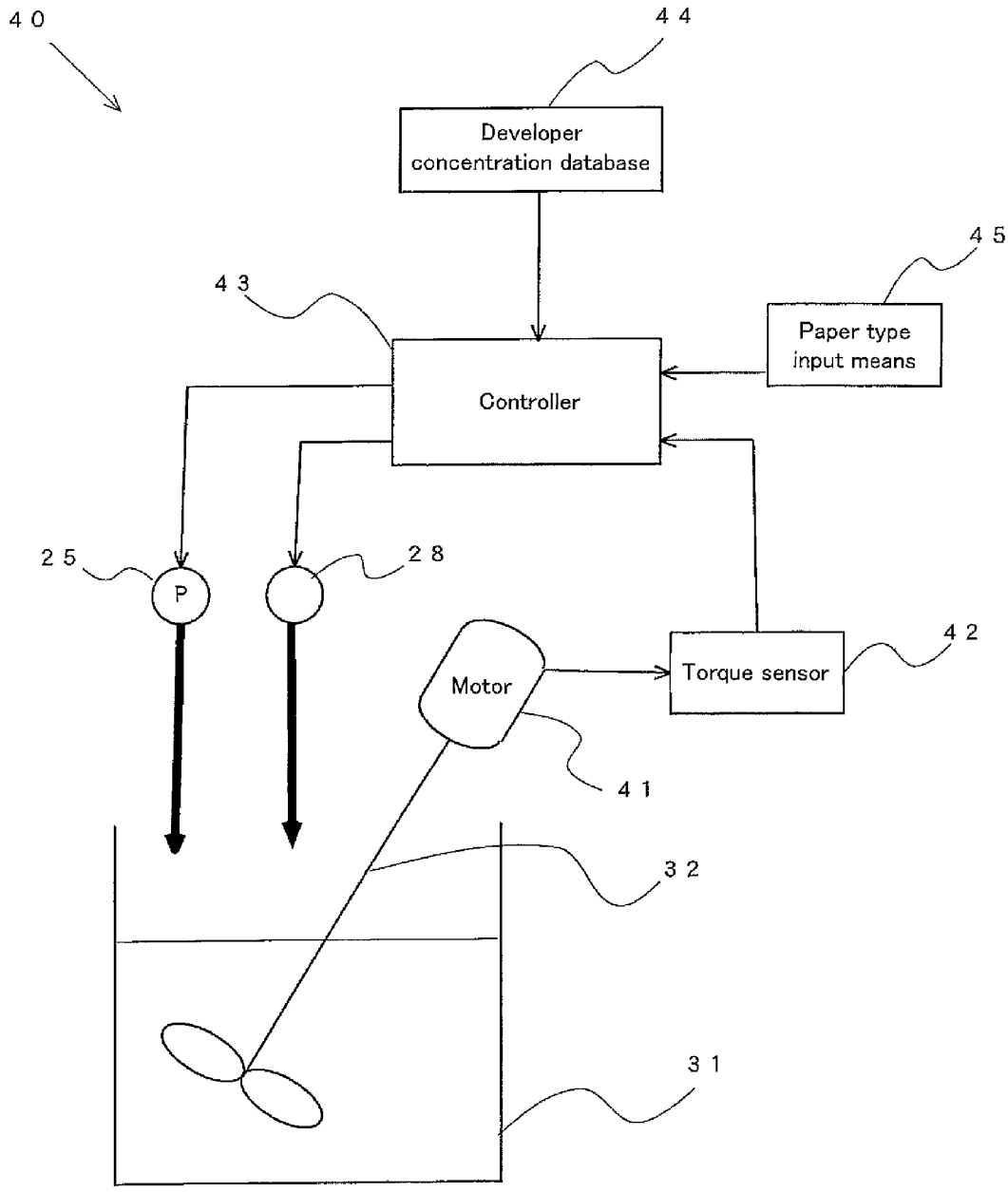
FIG. 6 is a diagram showing a developer concentration adjustment controlling section according to the invention.

FIG. 6 is a diagram showing a developer concentration adjustment controlling section 40. In FIG. 6, numeral 40 designates the developer concentration adjustment controlling section, 41 designates a motor, 42 designates a torque sensor, 43 designates a controller, 44 designates a developer concentration database, and 45 designates a paper type input means. In the invention, the image forming section 1, the developer concentration adjusting section 22, and the developer concentration adjustment controlling section 40 compose a development system.

First, the developer concentration adjusting control in the normal state will be described. Normally, the developer concentration adjustment controlling section 40 controls the concentration of the developer in the developer concentration adjusting tank 31 to be maintained at 25%. The developer in the developer concentration adjusting tank 31 is agitated by the propeller as the agitating member 32. The motor 41 rotates the propeller. The torque sensor 42 detects the current value of the motor 41. The controller 43 detects the current concentration of the developer in the developer concentration adjusting tank 31 from the detected value of the torque sensor 42, the motor current value stored in the developer concentration database 44 which is a storing medium such as an IC chip, and data showing the relation between the motor torque and the developer concentration. Based on the detected value, the controller 43 controls the first pump 25 for adjusting the amount of high-concentration toner from the toner tank 23 and opens or closes the first valve 28 for adjusting the amount of liquid carrier from the liquid carrier tank 26 so as to add a suitable amount of high-concentration toner and a suitable amount of liquid carrier to make the developer concentration to be about 25%. The developer having adjusted concentration of about 25% is supplied to the developer container 7 by the second pump 33 according to need.

The case required to supply the high-concentration toner into the developer concentration adjusting tank 31 is a case that the consumption of toner particles is increased by printing a lot of high density images with high image density so that a reduced amount of toner particle are collected by the development roller cleaner 10 so as to reduce the concentration of the developer in the developer concentration adjusting tank 31. The case required to supply the liquid carrier into the developer concentration adjusting tank 31 is a case that the consumption of toner particles is decreased by printing a lot of low density images with image density of a few % so that high concentration toner is collected by the development roller cleaner 10 so as to increase the concentration of the developer in the developer concentration adjusting tank 31.

Next, the developer concentration adjusting control depending on the paper type will be described. The paper type input means 45 is a printing setting screen of a PC or a setting screen of a control panel of a cartridge of a printer body to which paper sheets are set or the printer body. As the paper type is determined by the paper type input means 45, the controller 43 controls the developer concentration depending on the paper type. For example, the controller 43 controls the concentration to be about 20% for a paper smoother than regular paper such as coated paper, to be about 25% for regular paper (for example, "J" paper available from Fuji Xerox Co., Ltd.) as default paper of the standard setting (NN environment at 23° temperature and 30% humidity), and to be about 30% for paper rougher than regular paper such as rough paper, e.g. Neenah bond paper, and recycled paper. The controlling method is just changing the setting concentration of the developer without changing other settings.

In the developer concentration adjusting control, in case of employing a developer supplying roller provided with grooves such as an anilox roller, the grooves may be clogged with toner particles when the concentration of the developer is set high. In this state, it is impossible to measure the thickness of the film with accuracy. For this, in this embodiment, the controller 43 carries out the following low-concentration termination sequence. That is, assuming that the point when the driving of the photoconductor 13 and the intermediate transfer belt 61 is turned off is termination of printing operation, the controller 43 terminates the printing action after controlling the concentration of the developer in the developer concentration adjusting tank 31 to be less than about 25% as the default (regular paper, NN environment at 23° temperature and 30% humidity) at the termination of the printing operation.

By carrying out the low-concentration termination sequence, when a printing operation is restarted after the printing operation, the grooves are not clogged with toner particles so that the thickness of the film can be measured with accuracy.

Figure 7:
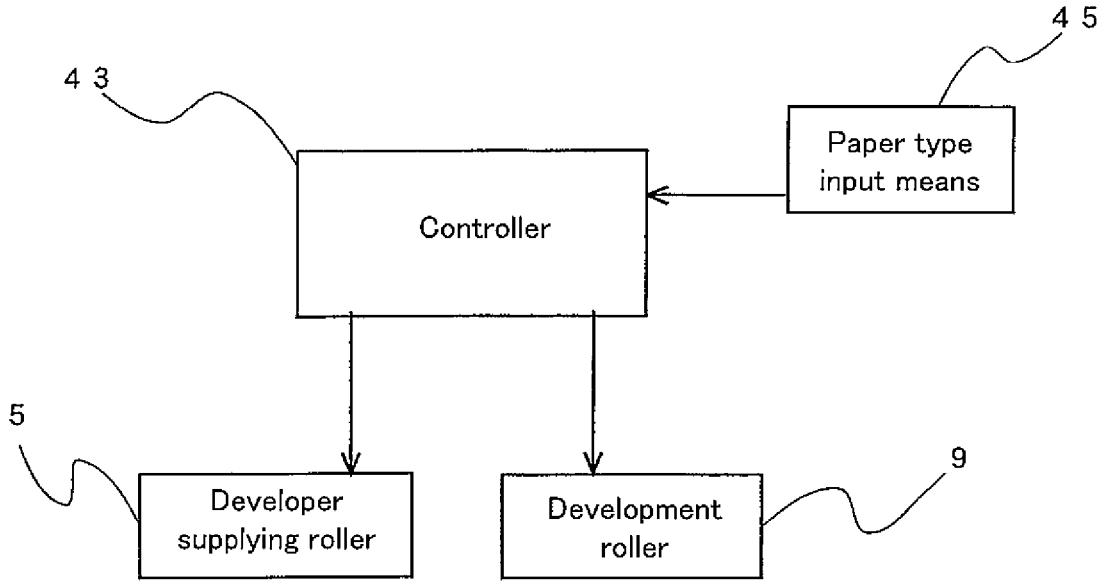
FIG. 7 is a diagram showing a circumferential velocity control depending on the paper type according to the invention.

Next, the development roller velocity adjusting control depending on the paper type will be described with reference to FIG. 7. The paper type input means 45 is a printing setting screen of a PC or a setting screen of a control panel of a cartridge of a printer body to which paper sheets are set or the printer body. As the paper type is determined by the paper type input means 45, the controller 43 controls the circumferential velocity of the development roller 9 depending on the paper type. It should be understood that the controller 43 may control the circumferential velocity of the developer supplying roller 5 or the circumferential velocity of both the developer supplying roller 5 and the development roller 9.

FIG. 8 shows the relation of circumferential velocity differential between the development roller 9 and the developer supplying roller 5. In case of regular paper (for example, "J" paper available from Fuji Xerox Co., Ltd.) as default paper, there is no circumferential velocity differential between the development roller 9 and the developer supplying roller 5 so that the film thickness of the development roller 9 is 6.5 μm. In case of paper rougher than regular paper such as rough paper. e.g. Neenah bond paper, the circumferential velocity of the development roller 9 is increased to about 235 mm/sec so that the circumferential velocity of the development roller 9 is higher than the developer supplying roller 5 by about 21 mm/sec. According to the circumferential velocity differential, the film thickness of the development roller 9 is increased to about 7.15 μm. In case of coated paper smoother than the regular paper such as Zanders ikono silk, the circumferential velocity of the development roller is decreased to about 203 mm/sec so that the circumferential velocity of the development roller 9 is lower than the developer supplying roller 5 by about 11 mm/sec. According to the circumferential velocity differential, the film thickness of the development roller 9 is decreased to about 6.2 μm.

Therefore, the amount of the developer is increased by increasing the film thickness of the development roller 9 in case of rough paper and the amount of the developer is reduced by decreasing the film thickness of the development roller 9 in case of coated paper, thereby ensuring constant density relative to respective paper types.

It should be noted that the termination of a printing operation may be halting of a fixing device or turning OFF of a heat source for the fixing device.

When there is an input that the paper is rough paper such as Neenah carbon paper for the developer concentration adjusting control or the development roller velocity control, the developer on the development roller 9 contains a reduced amount of liquid carrier and an increased amount of toner particles. Therefore, the controller 43 may increase the development contrast potential so as to increase the amount of developer adhering to the imaging portion of the photoconductor 13. For example, the potential of the development roller 9 is set to 400V and the charging potential of the non-imaging portion of the photoconductor 13 is set to 800V in the normal state. However, when the paper type input means 45 inputs that the paper is rough paper, the controller 43 increases the potential of the development roller 9 to 450V and increases the charging potential of the non-imaging portion of the photoconductor 13 to 900V without changing the charging potential of the imaging portion of the photoconductor 13. Accordingly, the amount of developer on the imaging portion of the photoconductor 13 is increased It should be noted that the developer concentration adjusting control may be carried out depending on the paper type together with carrying out the development roller velocity adjusting control depending on the paper type.

Figure 9:
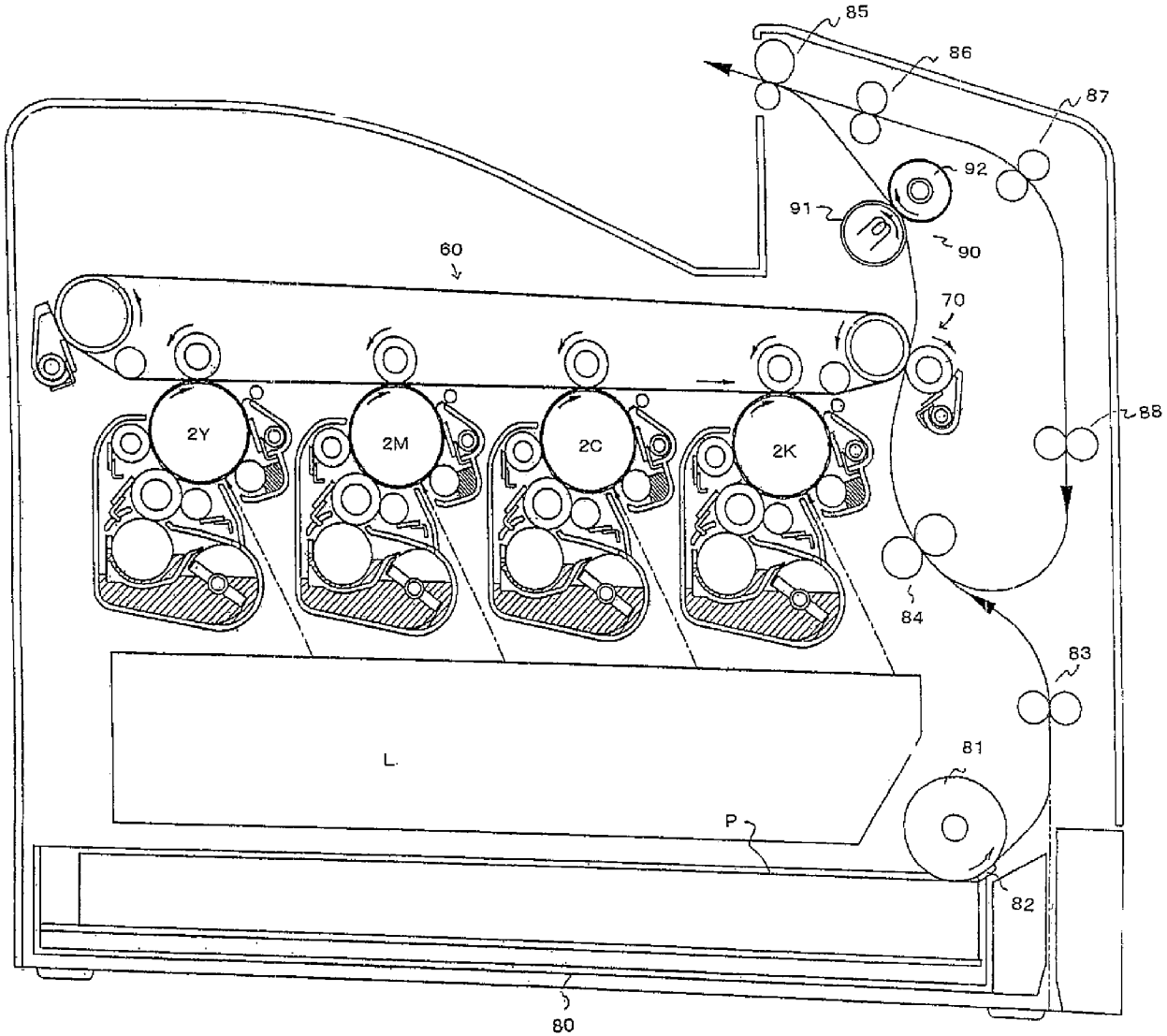
FIG. 9 is an illustration showing a printer to which a development system according to the invention is adapted.

FIG. 9 is an illustration showing a printer to which the development system of the invention is adapted. In FIG. 9, numeral 80 designates a paper feeding cassette, 81 designates a pick-up roller, 82 designates a separating pad, 83 designates a pair of carrying rollers, 84 designates a pair of resist rollers, 85 designates a pair of discharging rollers, 86, 87, and 88 designate pairs of recycling rollers, 90 designates a fixing device, 91 designates a heat roller, 92 designates a pressure roller, P designates a recording medium, and L designates a laser scanning optical system.

A sheet of recording medium P is separately picked up from recording media P such as paper sheets stacked in the feeding cassette 80 by the pick-up roller 81 and the separating pad 82 and is fed to the secondary transfer unit 70 through the pair of carrying rollers 83 and the pair of resist rollers 84 for correcting the orientation and the feeding timing of the recording medium P. In the secondary transfer unit 70, a full-color image is secondarily transferred to the recording medium P. The recording medium P with secondarily transferred image passes the fixing device 90 which comprises the heat roller 91 with built-in heating means and the pressure roller 92 with elastic member such as rubber on the periphery thereof so that the thermoplastic resin contained in the full-color image is fused and thus the image is fixed to the recording medium P, thereby obtaining a desired image.

According to the development system of the invention, the development conditions are adjusted depending on the paper type, thereby keeping the density constant relative to various paper types.

In addition, the developer concentration is adjusted depending on the paper type, thereby keeping the density constant relative to various paper types. When it is inputted that the paper is a paper rougher than the default paper, the concentration of developer is increased by decreasing the rate of the liquid carrier in the developer so as to reduce the chance that toner particles are drawn by fibers of the transfer paper together with the liquid carrier, thereby obtaining a desired concentration. When it is inputted that the paper is a paper rougher than the default paper, the contrast potential of the photoconductor and the development roller is increased, thereby increasing the amount of developer adhering to the imaging portion of the photoconductor. Further, since the developer concentration is calculated from the value detected by the torque sensor and data from the developer concentration database, the adjustment response is improved.

Since the circumferential velocity differential between the developer supplying roller and the development roller is adjusted depending on the paper type, the density is kept constant relative to various paper types. In case of a paper rougher than the default paper, the circumferential velocity of the developer supplying roller is controlled to be higher than the circumferential velocity of the development roller or the contrast potential of the photoconductor and the development roller is increased, thereby increasing the amount of developer. In case of a paper smoother than the default paper, the circumferential velocity of the developer supplying roller is controlled to be lower than the circumferential velocity of the development roller, thereby decreasing the amount of developer. Further, the developer concentration is calculated from the value detected by the torque sensor and data from the developer concentration database, thereby improving the adjustment response. The image forming section comprises a photoconductor liquid carrier removing means for removing the liquid carrier from the photoconductor, thereby decreasing the amount of liquid carrier.

According to the development system of the invention, the developer concentration in the developer concentration adjusting tank is controlled to be lower than the default value at termination of a printing operation and, after that, the printing action is terminated. Therefore, even when a developer supplying roller with grooves is employed, the developer supplying roller is not clogged with toner particles. In addition, the developer concentration is adjusted according to the paper type, thereby keeping the density constant relative to various paper types. Further, the developer concentration is calculated from the value detected by the torque sensor and data from the developer concentration database, thereby improving the adjustment response.

Moreover, according to the image forming apparatus of the invention, the development conditions, especially the developer concentration and the circumferential velocity differential between the developer supplying roller and the development roller are adjusted depending on the paper type, thereby keeping the density constant relative to various paper types.

What is claimed is:

1. A development system comprising: an image forming section including a development roller that carries developer, a developer supplying roller that supplies the developer to the development roller, a developer container that supplies the developer to the developer supplying roller, a photoconductor on which a developed image is formed with the developer carried by the development roller, and a transfer means that transfers the developed image on the photoconductor; a developer concentration adjusting section including a toner tank that reserves developer of which concentration is higher than that of the developer in the developer container, a liquid carrier tank that reserves liquid carrier, and a developer concentration adjusting tank into which the high-concentration developer is fed from the toner tank and the liquid carrier is fed from the liquid carrier tank; a paper type input means that inputs a paper type; and a developer concentration adjustment controlling section that controls development conditions depending on the paper type inputted by the paper type input means.

2. A development system as claimed in claim 1, wherein the developer concentration adjustment controlling section controls the developer concentration adjusting section to adjust the concentration of the developer depending on the paper type inputted by the paper type input means.

3. A development system as claimed in claim 2, wherein when the paper type input means inputs that the subject paper is a paper having a surface roughness larger than that of a regular paper, the developer in the developer concentration adjusting tank is controlled to have higher concentration.

4. A development system as claimed in claim 2, wherein when the paper type input means inputs that the subject paper is a paper having a surface roughness larger than that of a regular paper, the developer concentration adjustment controlling section increases a contrast potential of the photoconductor and the development roller.

5. A development system as claimed in claim 2, wherein the developer concentration adjusting section comprises a motor and an agitating member which is driven by the motor to agitate the developer in the developer concentration adjusting tank, and the developer concentration adjustment controlling section comprises a torque sensor that detects a torque value of the, motor and a developer concentration database that stores data of developer concentrations corresponding to torque values of the motor and calculates the developer concentration from the value detected by the torque sensor and the data in the developer concentration database.

6. A development system as claimed in claim 1, wherein the developer concentration adjustment controlling section controls a circumferential velocity differential between the developer supplying roller and the development roller depending on the paper type inputted by the paper type input means.

7. A development system as claimed in claim 6, wherein when the paper type input means inputs that the subject paper is a paper having a surface roughness larger than that of a regular paper, a circumferential velocity of the developer supplying roller is controlled to be higher than a circumferential velocity of the development roller.

8. A development system as claimed in claim 6, wherein when the paper type input means inputs that the subject paper is a paper having a surface roughness larger than that of a regular paper, the developer concentration adjustment controlling section increases a contrast potential of the photoconductor and the development roller.

9. A development system as claimed in claim 6, wherein when the paper type input means inputs that the subject paper is a paper having a surface roughness smaller than that of a regular paper, a circumferential velocity of the developer supplying roller is controlled to be lower than a circumferential velocity of the development roller.

10. A development system as claimed in claim 6, wherein the developer concentration adjusting section comprises a motor and an agitating member which is driven by the motor to agitate the developer in the developer concentration adjusting tank, and the developer concentration adjustment controlling section comprises a torque sensor that detects a torque value of the motor and a developer concentration database that stores data of developer concentrations corresponding to torque values of the motor and calculates the developer concentration from the value detected by the torque sensor and the data in the developer concentration database.

11. A development system as claimed in claim 6, wherein the photoconductor has a photoconductor liquid carrier removing means that removes the liquid carrier on the photoconductor.

12. A development system comprising: an image forming section including a development roller that carries developer, a developer supplying roller having grooves formed therein that supplies the developer to the development roller, a developer container that supplies the developer to the developer supplying roller, a photoconductor on which a developed image is formed with the developer carried by the development roller, and a transfer means that transfers the developed image on the photoconductor; and a developer concentration adjusting section including a toner tank that reserves developer of which concentration is higher than that of the developer in the developer container, a liquid carrier tank that reserves liquid carrier, and a developer concentration adjusting tank into which the high-concentration developer is fed from the toner tank and the liquid carrier is fed from the liquid carrier tank, wherein the developed image is formed by the image forming section with the developer of which concentration is adjusted by the developer concentration adjusting section, said development system further comprising a developer concentration adjustment controlling section including a control means that controls the developer concentration adjusting section to adjust the developer concentration depending on an image forming condition, wherein the developer concentration adjustment controlling section carries out a termination sequence of terminating an action of an apparatus after controlling the developer concentration in the developer concentration adjusting tank to be lower than a default value at a termination of a printing operation.

13. A development system as claimed in claim 12, wherein a developer concentration adjustment controller includes a paper type input means that inputs a paper type and controls the control means depending on the paper type inputted by the paper type input means.

14. A development system as claimed in claim 12, wherein the developer concentration adjusting section comprises a motor and an agitating member which is driven by the motor to agitate the developer in the developer concentration adjusting tank, and the developer concentration adjustment controlling section comprises a torque sensor that detects a torque value of the motor and a developer concentration database that stores data of developer concentrations corresponding to torque values of the motor, wherein the control means calculates the developer concentration from the value detected by the torque sensor and the data in the developer concentration database.

15. An image forming apparatus comprising: an image forming section including a development roller that carries developer, a developer supplying roller that supplies the developer to the development roller, a developer container that supplies the developer to the developer supplying roller, a photoconductor on which a developed image is formed with the developer carried by the development roller, an intermediate transfer belt to which the developed image on the photoconductor is transferred, a primary transfer roller which is disposed inside the intermediate transfer belt to face the development roller, an intermediate transfer belt squeezing roller that recovers liquid carrier on the intermediate transfer belt, a squeezing roller cleaner that scrapes the liquid carrier recovered on the intermediate transfer belt squeezing roller, a squeezing roller cleaner reservoir that reserves the liquid carrier scraped by the squeezing roller cleaner, and a secondary transfer roller that transfers the transferred image on the intermediate transfer belt to a paper sheet; and a developer concentration adjusting section including a toner tank that reserves developer of which concentration is higher than the concentration of the developer in the developer container, a liquid carrier tank that reserves liquid carrier, a developer concentration adjusting tank into which the high-concentration developer is fed from the toner tank and the liquid carrier is fed from the liquid carrier tank so as to adjust the concentration of the developer, and a paper type input means that inputs a paper type, wherein the image forming apparatus further comprises a developer concentration adjustment controlling section that controls development conditions depending on the paper type inputted by the paper type input means.

16. An image forming apparatus as claimed in claim 15, wherein the developer concentration adjustment controlling section controls the developer concentration adjusting section to adjust the concentration of the developer depending on the paper type inputted by the paper type input means.

17. An image forming apparatus as claimed in claim 15, wherein the developer concentration adjustment controlling section controls a circumferential velocity differential between the developer supplying roller and the development roller depending on the paper type inputted by the paper type input means.

* * * * *